United States Patent [19]

Hobbie

[11] Patent Number: 4,907,362

[45] Date of Patent: Mar. 13, 1990

[54] SUB-CALIBER FIREARM

[76] Inventor: Edward H. Hobbie, P.O. Box 3, South Deerfield, Mass. 01342

[21] Appl. No.: 165,532

[22] Filed: Mar. 8, 1988

[51] Int. Cl.[4] ..... F41C 21/00

[52] U.S. Cl. ..... 42/77; 42/49.02; 89/29

[58] Field of Search ..... 42/77, 49.02; 89/196, 89/29, 128

[56] References Cited

U.S. PATENT DOCUMENTS

| | | | |
|---|---|---|---|
| 640,070 | 2/1899 | Aeschbacher . | |
| 732,540 | 4/1903 | Garrison . | |
| 969,011 | 7/1910 | Vedder . | |
| 2,090,657 | 11/1937 | Williams | 42/4 |
| 2,296,729 | 9/1942 | Mossberg | 42/49.02 |
| 2,872,850 | 2/1959 | Davenport | 89/159 |
| 2,898,693 | 5/1959 | Ruger | 42/77 |
| 3,504,594 | 10/1970 | Greeley | 89/163 |
| 3,724,326 | 4/1973 | Day | 89/196 |
| 3,772,812 | 11/1973 | Day | 42/49.02 |
| 4,253,377 | 1/1981 | Arnett | 89/163 |
| 4,542,606 | 10/1985 | Hoenig | 42/75 B |
| 4,608,909 | 9/1986 | Peters | 89/196 |

FOREIGN PATENT DOCUMENTS

| | | | |
|---|---|---|---|
| 1933285 | 7/1969 | Fed. Rep. of Germany | 42/77 |
| 756432 | 12/1933 | France | 42/77 |
| 16938 | of 1891 | United Kingdom | 42/77 |

*Primary Examiner*—Deborah L. Kyle
*Assistant Examiner*—Richard W. Wendtland
*Attorney, Agent, or Firm*—Lahive & Cockfield

[57] ABSTRACT

A sub-caliber automatic pistol of the double-action breech block type incorporates a frame having barrel-mounting ribs, a handle, a barrel-receiving slide with integral breech block, a firing mechanism of a larger caliber pistol, and a magazine adapted for storing a plurality of sub-caliber cartridges. The pistol includes an interchangeable barrel terminating rearwardly in a downwardly descending lug having an integral feed ramp defining a cartridge path for the larger caliber cartridges. A feed spacer is affixed to the barrel lug for defining a sub-caliber cartridge path which is elevated with respect to the first cartridge path.

16 Claims, 4 Drawing Sheets

SUB-CALIBER FIREARM

BACKGROUND OF THE INVENTION

This invention relates in general to automatic pistols, and in particular, provides a sub-caliber conversion unit for double-action automatic pistols of the breech block type.

Automatic pistols of this type conventionally include a frame, a barrel, and a breech block, or slide. The breech block is reciprocally mounted on the upper portion of the frame of the pistol and houses a recoil spring. A locking mechanism selectively locks the slide to the barrel at the time of firing. A magazine is mounted in a handle or grip portion of the frame, for storing cartridges.

Upon firing, the barrel and slide recoil backward in coupled connection for a short distance. The locking mechanism then disconnects the barrel from the slide, allowing the slide to continue its rearward movement against the force of the recoil spring. As the slide moves backward, it cocks a firing mechanism and actuates an extractor and ejector, for respectively extracting and ejecting the spent cartridge from the receiver. When the recoil spring is fully compressed, it pushes the slide forward, causing a cartridge to be pushed off the top of the magazine stack and into the chamber of the barrel. As the slide approaches its initial forward position, the slide re-engages with the barrel.

In the conventional Colt Government Model .45 caliber pistol, the barrel is connected to the slide by locking lugs and is held in place by the force of the recoil spring. The barrel engages the frame by means of a pivoting link. In contrast, in the Smith & Wesson Model 645, no barrel link connects the barrel to the frame Instead, the barrel rides on an inclined plane machined into the frame. Upon recoil, the rear part of the barrel is pulled downward and out of engagement with the slide by the action of mating ribs on the frame and corresponding ribs on the lower surface of the barrel.

A number of sub-caliber conversion systems have been developed for the Colt Government Model .45 caliber automatic pistol. The following U.S. Pat. Nos. disclose examples of such systems:

| | |
|---|---|
| 2,090,657 | Williams |
| 2,872,050 | Davenport |
| 2,898,693 | Ruger |
| 3,504,594 | Greeley |
| 3,724,326 | Day |
| 4,253,377 | Arnett |

The Williams patent discloses a sub-caliber conversion unit for the Colt Government Model .45 automatic pistol, including a sub-caliber barrel, ejector, extractor, slide and magazine. Williams also discloses a chamber member for increasing sub-caliber recoil to approximate the perceived recoil of the standard .45 caliber cartridges.

The Davenport patent discloses a sub-caliber device for the Colt .45 pistol, including a sub-caliber barrel and chamber unit which floats within a sleeve affixed to the frame of the firearm.

The Ruger patent discloses a sub-caliber conversion for the Colt .45 pistol, including a .22 caliber barrel which is operatively affixed to the frame of the firearm, a breech block receiver which engages the frame in the same manner as the original slide but which is secured in its operative position to the barrel and indirectly to the frame, and a blow-back breech block mounted in the receiver. A sub-caliber magazine is also disclosed.

The Greeley patent discloses a sub-caliber conversion unit for a Colt .45 automatic pistol, including a barrel having a depending block formed with a downward and rearward sloping slot which engages a pivot pin 28, so that the barrel upon firing is tilted and unlocked from the slide to effect operation of the extractor.

The Day patent discloses a sub-caliber conversion unit adapted to be detachably secured to and firmly supported by the lower receiver group of a larger caliber pistol such as the Colt .45 caliber automatic pistol, wherein the slide of the conversion unit operates independently of the barrel. A sub-caliber magazine insert is also disclosed.

The Arnett patent discloses a sub-caliber conversion for an automatic pistol such as the Colt Government Model .45, including a sub-caliber barrel mounted in the slide and detachably connected to the frame by a pivotal link A sub-caliber magazine is disclosed, and a cambered, semi-flexible extracter is utilized to capture and extract cartridges of both the larger caliber and the sub-caliber.

Each of the above patents describes sub-caliber conversions for the Colt Government Model .45 caliber automatic pistol. However, no device or system previously in existence provides a sub-caliber conversion for the Smith & Wesson Model 645 .45 automatic pistol, with its inclined plane barrel-locking system entirely different from that of the Colt Government Model Moreover, existing sub-caliber conversion systems require numerous parts changes or modifications to the larger caliber pistol, including changes to the slide, extractor, ejector, recoil spring, hammer spring (or mainspring) and magazine, a well as to the barrel. There accordingly exists a need for a simple, inexpensive sub-caliber conversion unit for Smith & Wesson Model 645 .45 automatic pistols and the like.

It is thus an object of the invention to provide a sub-caliber conversion unit for the Smith & Wesson Model 645 .45 automatic pistol.

It is another object of the invention to provide a Smith & Wesson Model 645 sub-caliber conversion unit which is inexpensive, requires a minimum of modifications or new parts for the larger caliber pistol, is simple to install and remove, and which maintains high accuracy levels.

It is a further object of the invention to provide a magazine for a Smith & Wesson Model 645 sub-caliber conversion unit which can accommodate cartridges of both the larger caliber and the sub-caliber.

It is yet another object of the invention to provide a magazine for a Smith & Wesson Model 645 sub-caliber conversion unit which can accommodate rimmed cartridges such as .38 Special.

Other general and specific objects of the invention will in part be obvious and will in part appear hereinafter.

SUMMARY OF THE INVENTION

The invention provides a sub-caliber automatic pistol of the double-action breech block type including a frame having barrel-mounting ribs, a handle, a barrel-receiving slide with integral breech block, and a firing mechanism of a larger caliber pistol. A pistol according to the invention includes an interchangeable barrel which terminates rearwardly in a downwardly depending lug having an integral feed ramp defining a first cartridge feed line substantially identical to that corresponding to cartridges of the larger caliber.

In accordance with the invention, the barrel is detachably and selectively locked in battery with the frame by barrel ribs integral with the barrel and matable with the barrel-mounting ribs on the frame. A feed spacer element is affixed to the barrel lug for defining a second, selectively elevated feed line corresponding to sub-caliber cartridges.

The invention also includes a pivoted frame mounted ejector interconnected to the slide and travelling in an angled impingement path, for striking and ejecting a spent sub-caliber cartridge, and a spring-actuated rigid extractor, for extracting sub-caliber cartridges.

Another aspect of the invention provides a sub-caliber conversion unit for detachable engagement with the receiver group of a larger caliber pistol of the double-action breech block type, such pistol including a frame having barrel-mounting ribs, a handle, a barrel-receiving slide with integral breech block, a pivoted ejector interconnected to the slide and travelling in an angled impingement path for striking and ejecting a spent sub-caliber cartridge, a spring-actuated rigid extractor and a firing mechanism.

A conversion unit according to the invention comprises an interchangeable barrel that terminates rearwardly in a downwardly depending lug having an integral feed ramp defining a first cartridge feed line substantially identical to that corresponding to cartridges of the larger caliber. The barrel is detachably and selectively locked to the slide by barrel ribs integral with the barrel and matable with the barrel-mounting ribs on the frame.

A conversion unit according to the invention also includes a feed spacer element affixed to the barrel lug for selectively defining a second, elevated feed line corresponding to sub-caliber cartridges.

The invention further provides a detachable magazine assembly, mountable in the handle, for holding sub-caliber cartridges In one embodiment of the invention, the magazine assembly includes a magazine adapted to hold cartridges of the larger caliber, and a magazine liner mounted in the magazine and adapted to hold sub-caliber cartridges. The magazine liner is adaptable to hold rimmed cartridges. In another embodiment of the invention, the magazine assembly is adapted for holding cartridges of both the larger caliber and the sub-caliber.

In another aspect of the invention, the feed spacer element and the barrel lug are joined by metal films. Alternatively, the feed spacer element is welded or pinned to the barrel lug.

The invention accordingly comprises apparatus embodying features of construction, combinations of elements and arrangements of parts, as exemplified in the following detailed disclosure, and the scope of the invention is indicated in the claims.

BRIEF DESCRIPTION OF THE DRAWINGS

For a fuller understanding of the nature and objects of the invention, reference should be made to the following detailed description and the accompanying drawings, in which.

DESCRIPTION OF PREFERRED EMBODIMENTS

Figure 1:
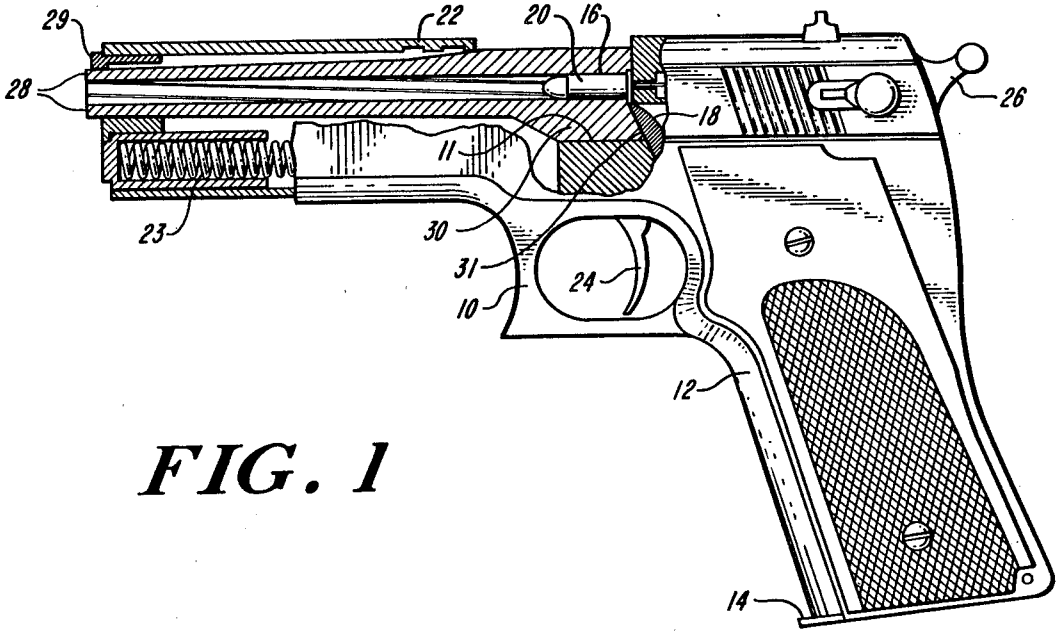
FIG. 1 is a partially broken-away side view of a Smith & Wesson Model 645 .45 automatic pistol modified in accordance with the invention to fire a sub-caliber cartridge.

FIG. 1 is a partially broken away side view of a Smith & Wesson Model 645 .45 caliber automatic pistol modified in accordance with the invention to fire a sub-caliber cartridge such as the nine millimeter or .38 Special cartridge. Alternatively, an automatic pistol capable of firing cartridges of different calibers may be constructed in accordance with the principles of the invention. In a preferred embodiment of the invention, a pistol modified for firing sub-caliber cartridges utilizes all components of the larger caliber pistol, with the exception of the barrel and the recoil spring.

In accordance with the invention, the pistol shown in FIG. 1 comprises a frame 10 having a grip or handle 12 with a recess therein for receiving a magazine 14 to hold cartridges. Mounted on the frame 10 is a barrel 28 and a breech block or slide 22. The rear portion of the slide 22 serves to close the breech of the barrel, and the forward projecting portion of the slide surrounds the barrel 28. The barrel 28 includes a chamber 16 for receiving a cartridge 20. The barrel 28 also includes a downwardly depending lug 30 having an integral feed ramp 31. A feed riser or feed spacer 18, more fully discussed hereinafter, is affixed to integral feed ramp 31. The firing mechanism of the pistol forms no part of the present invention and is not shown in FIG. 1, with the exception of hammer 26 and trigger 24.

In accordance with conventional Smith & Wesson automatic pistol construction, the barrel 28 is slidably mounted to the frame by means of an inclined plane formed by ribs machined into the frame 10. Upon firing, the barrel 28 and slide 22 recoil backward as a unit for a short distance. As recoil continues, the rear part of the barrel 28 is pulled downward and out of engagement with the slide 22 by ribs 11 on the frame 10 which mate with corresponding ribs **28*a* on the lower surface of the barrel 28. These corresponding barrel ribs and frame ribs are not shown in FIGS. 1**.

Thus, after a short rearward movement of barrel 28 and slide 22 in unison, the rear part of the barrel 28 is caused to move downward, withdrawing the barrel 28 from engagement with the slide 22, permitting the slide to continue to move rearward with respect to and separately from the barrel 28. This separate rearward movement of the slide 22 effects the extraction and ejection of the empty shell in a manner known in the art. A recoil spring 23 causes the slide 22 to return in the forward direction, and during such forward movement a cartridge is withdrawn from the magazine 14 and pushed into the chamber 16 of the barrel 28 in position for firing Near the end of its forward movement, slide 22 again engages the barrel 28.

In accordance with conventional practice, the barrel 28 and recoil spring 23 are configured so that the recoil spring 23 pushes against the upper rear portion of barrel 28. Barrel 28 is pushed against a slide stop pin, not shown, causing the barrel 28 to rotate around the axis of the slide stop pin. This rotation of the barrel 28 pushes the lower portion of the muzzle end of barrel 28 against the muzzle bushing 29 with an alignment force proportional to the force of the recoil spring 23. This force, combined with the close fit of the slide 22 to the belled bearing surfaces of the muzzle end of barrel 28, produces a consistent re-alignment force to locate the barrel 28 relative to the frame 10.

In a preferred embodiment of the invention, the recoil spring 23 is shortened to compensate for the lower recoil force generated by sub-caliber cartridges. Alternatively, the recoil spring 23 is reformed to a lower strength using windings of different wire.

Figure 2A:
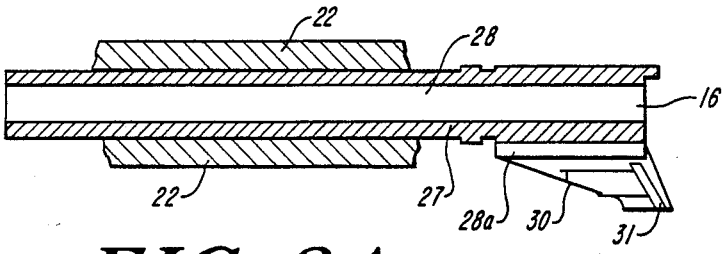
FIG. 2A is an enlarged view partially in cross-section and partially broken away, showing detail of a conventional barrel utilized in a Smith & Wesson Model 645 pistol.

FIG. 2A illustrates a conventional barrel utilized in a Smith & Wesson Model 645 pistol. The barrel 27, shown in engagement with slide 22, provides a chamber 16 and terminates rearwardly in a downwardly descending lug 30 that includes 28*a*, and integral feed ramp 31. The feed ramp 31 defines a first cartridge feed line suitable for feeding .45 caliber cartridges.

Figure 2B:
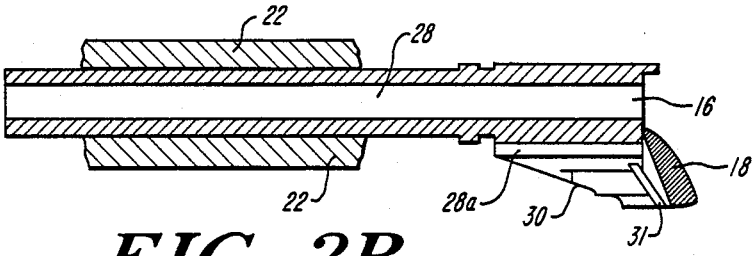
FIG. 2B is an enlarged view partially in cross section and partially broken away, showing detail of a barrel constructed in accordance with the invention.
Figure 2C:
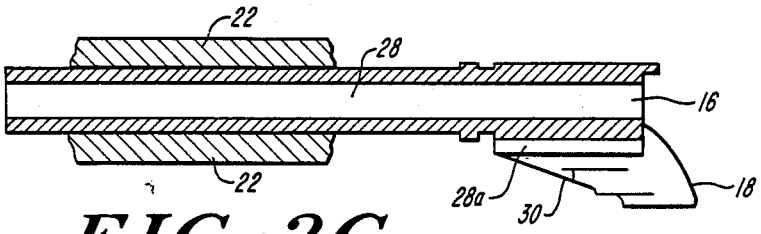
FIG. 2C is an enlarged view partially in cross-section and partially broken away, showing detail of another embodiment of a barrel according to the invention.
Figure 2D:
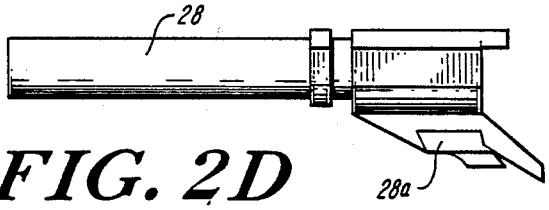
FIGS. 2D and 2E show detail of the barrel and barrel ribs.
Figure 2E:
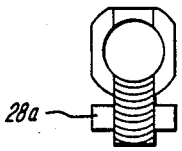

FIGS. 2D and 2E show detail of the barrel 28 and barrel ribs 28*a*.

FIG. 2B illustrates the configuration of the rear portion of a sub-caliber barrel constructed in accordance with the invention. In that embodiment of the invention, the sub-caliber barrel 28 is constructed using the monoblock portion of a conventional .45 caliber Smith & Wesson automatic pistol barrel. The barrel 28 may also utilize a sub-caliber liner. The sub-caliber barrel 28, which is surrounded by slide 22, provides a chamber 16 adapted for holding a sub-caliber cartridge for firing. The barrel 28 terminates rearwardly in a downwardly depending lug 30 that includes an integral feed ramp 31.

The integral feed ramp 31 defines a first cartridge feed line suitable for feeding and chambering cartridges of the larger caliber, such as .45 caliber. This first feed line is unsuitable for feeding sub-caliber cartridges, such as the nine millimeter cartridge. This is because the longitudinal centerline of a smaller diameter cartridge at the top of the magazine stack is higher than that of a larger caliber cartridge. Consequently, the chambering force of the slide will tend to skew the smaller diameter cartridge downward instead of feeding the cartridge straight into the chamber. Thus, a different, selectively higher cartridge feed line is provided by the inclined surface of feed spacer element 18.

In a preferred embodiment of the invention, in which the barrel assembly is constructed from a conventional barrel assembly, the feed spacer element 18 is welded or silver soldered to the integral feed ramp 31 of lug 30. In another embodiment of the invention, the feed spacer element 18 is pinned to integral feed ramp 31. Either method may be utilized in conjunction with a conventional Smith & Wesson barrel construction. Alternatively, as illustrated in FIG. 2C, a barrel assembly may be constructed specifically including element 18, but without the original feed ramp 31. Such an assembly may, for example, be fabricated by conventional investment casting techniques or utilizing a monobloc construction.

In all of these embodiments, the feed spacer element 18 selectively raises the cartridge feed line, so that sub-caliber cartridges feed into chamber 16 without skewing under chambering force. Additionally, the elevated feed line prevents shorter sub-caliber rounds, such as the nine millimeter cartridge, from advancing toward the chamber prior to the appropriate point in the loading cycle.

Figure 3A:
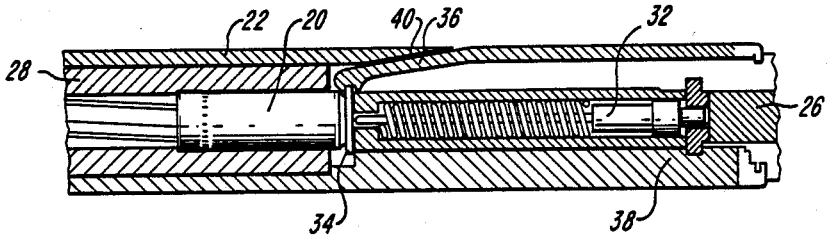
FIG. 3A is a horizontal section of the pistol of FIG. 1, giving detail of the extractor and ejector utilized in accordance with the invention.

FIG. 3A is a horizontal section of the pistol of FIG. 1, giving detail of the extractor and ejector utilized in accordance with the invention. A cartridge 20 in barrel 28 is shown in relation to slide 22, breech face 34, firing pin 32 and hammer 26. In accordance with conventional practice, the rim of cartridge 20 is captured by the forward end of extractor 36, which is mounted in adjacent extractor cut 40, for removal from the chamber of barrel 28 upon rearward movement of the slide 22. The spent cartridge is thrown clear of the pistol upon striking the ejector 38.

Figure 3B:
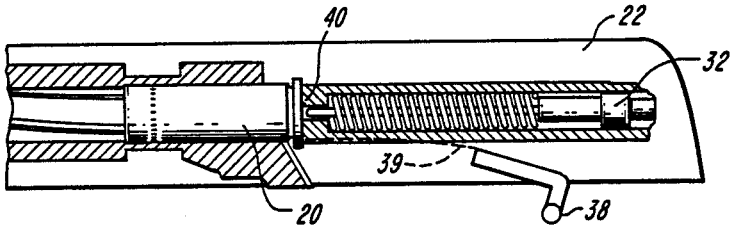
FIG. 3B is a vertical section of the pistol of FIG. 1, giving detail of the extractor and ejector utilized in accordance with the invention.
Figure 4A:
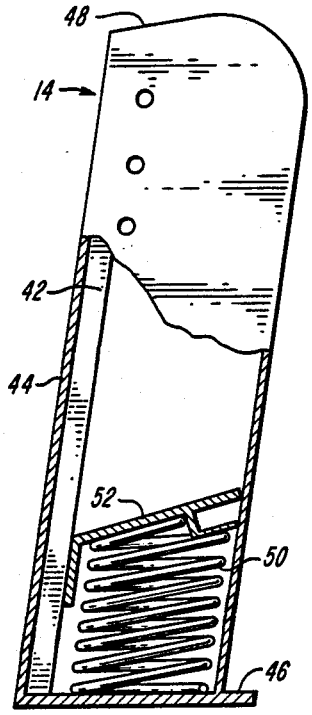
FIGS. 4A–4D depict a magazine utilized in the embodiment of FIG. 1, showing a sub-caliber magazine liner.
Figure 4B:
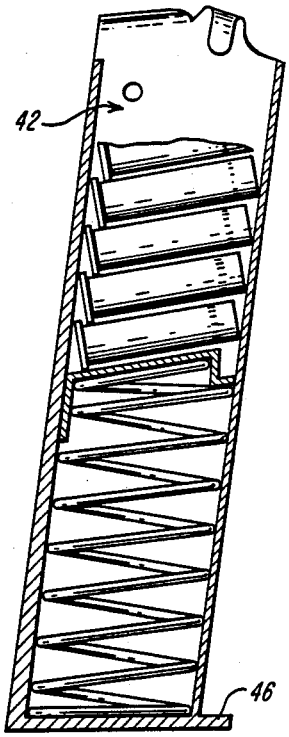
Figure 4C:
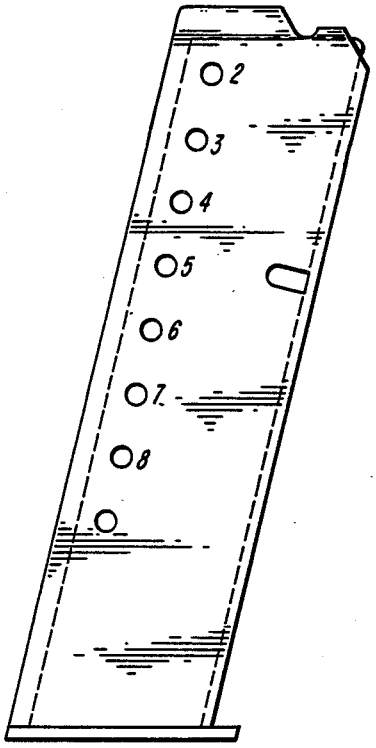
Figure 4D:
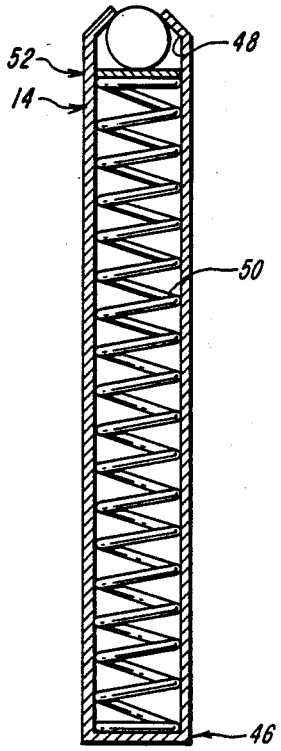

As FIG. 3B illustrates, the ejector 38 is preferably mounted pivotably to the frame, and travels in an upwardly angled impingement path 39 (shown in dashed lines in FIG. 3B) on the bottom of slide 22 This upwardly angled impingement path 39 provides positive contact between the pivoted ejector 38 and a sub-caliber cartridge 20. In particular, the case of sub-caliber cartridge 20 is struck by the ejector 38 travelling upwardly along angled impingement path 39.

The slide 22, which is substantially identical to the existing slide of the larger caliber pistol, preferably has a narrowed breech face 34 and an expanded ejector cut, as well as provision for the angled impingement path 39 described above. An ejector cut located adjacent to the feed rib, having a width equal to that of the ejector, and a length determined by the length of the cartridge being utilized, has been found to allow reliable ejection. The ejector cut may, for example, be ⅜ inches in length.

In a preferred embodiment of the invention, the conventional ejector lug of the Smith & Wesson ejector is at least partly milled away to allow the ejector 38 to rise into the ejector cut milled into the slide 22. The incorporation of this feature facilitates reliable ejection.

In one embodiment of the invention, the conventional extractor pad is at least partially milled away, to provide more reliable extraction of smaller diameter rims. In an alternative embodiment, the standard .45 caliber extractor is retained, and the extractor recess 40 is deepened.

FIGS. 4A–4D depict a magazine utilized in a preferred practice of the invention, showing a sub-caliber magazine liner. In accordance with the invention, the magazine 14, which is a conventional magazine utilized with cartridges of the larger caliber, includes outer magazine wall 44, base 46, feed lips 48, spring 50 and follower 52. The magazine 14 is fitted with a magazine insert or liner 42 adapted to hold cartridges of the desired sub-caliber, in a manner known in the art.

Another embodiment of the invention utilizes a conventional .45 caliber magazine suitably modified to hold nine millimeter cartridges In particular, the feed lips of a conventional magazine are bent inward to slightly reduce feed lip gap, and the follower is altered by grinding or other means, to accommodate the shorter nine millimeter cartridges, as well as the rearmost extension of the barrel during the reloading cycle. A modified magazine of this type is capable of holding and feeding both .45 caliber and sub-caliber cartridges, effectively providing a dual-caliber magazine.

A magazine utilizing a sub-caliber insert or liner has been found to feed more reliably than the dual caliber magazine when loaded with cartridges other than full metal jacketed (FMJ). The lined magazine illustrated in FIG. 4 thus allows a wider latitude in cartridge selection and bullet shape, and in particular, permits the use of rimmed cartridges such as .38 Special.

It will thus be seen that the invention efficiently attains the objects set forth above, among those made apparent from the preceding description. In particular, the invention provides a sub-caliber conversion unit for the Smith & Wesson Model 645 which is inexpensive, requires a minimum of modifications or new parts for the larger caliber pistol, is simple to install and remove, and which maintains high accuracy levels.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A sub-caliber automatic pistol of the double-action breech block type including a frame having barrel-mounting ribs, a handle, a barrel-receiving slide with integral breech block, and a firing mechanism of a pistol of a larger caliber and a magazine adapted for storing a plurality of sub-caliber cartridges, said sub-caliber automatic pistol comprising A. an interchangeable barrel, said barrel having a bore adapted for accommodating said sub-caliber cartridges and terminating rearwardly in a downwardly descending lug having an integral feed ramp defining a first cartridge feed line defining a cartridge path for cartridges of said larger caliber, said barrel being detachable, selectively movable with respect to said frame, and selectively locked in engagement with said slide by barrel ribs integral with said barrel and matable with said barrel-mounting ribs on said frame, said barrel ribs and said barrel-mounting ribs being substantially parallel to a central longitudinal axis of said barrel, said barrel ribs including at least one rib terminating at a first end proximate said feed ramp, B. Feed spacer means affixed to said barrel lug for defining a second, continuous feed line, said feed spacer means including an upper surface substantially intersecting with a surface of revolution defined by said bore, said second feed line defining a sub-caliber cartridge path which is elevated with respect to said first cartridge path, said second feed line having a selected vertical displacement from a horizontal plane defined by at least one of said barrel ribs, C. ejector means interconnected to said slide for striking and ejecting a spent sub-caliber cartridge, and D. extractor means, including a substantially rigid extractor element, for extracting sub-caliber cartridges from said magazine.

2. A sub-caliber conversion unit for detachable engagement with the receiver assembly of a larger caliber pistol of the double-action breech block type including a frame having barrel-mounting ribs, a handle, a barrel-receiving slide with integral breech block, an ejector interconnected to the slide for striking and ejecting a spent cartridge, a substantially rigid extractor and a firing mechanism, said conversion unit comprising A. an interchangeable barrel, said barrel having a bore adapted for accommodating sub-caliber cartridges and terminating rearwardly in a downwardly depending lug having an integral feed ramp defining a first cartridge feed line substantially identical to that corresponding to cartridges of the larger caliber, said barrel being detachable, detachably and selectively movable with respect to said frame, and selectively locked in engagement with said slide by barrel ribs integral with said barrel and matable with said barrel-mounting ribs on said frame, said barrel ribs and said barrel-mounting ribs being substantially parallel to a central longitudinal axis of said barrel, said barrel ribs including at least one rib terminating at a first end proximate said feed ramp, and B. feed spacer means affixed to said barrel lug for selectively defining a second, continuous, elevated feed line, corresponding to sub-caliber cartridges, said feed spacer means including an upper surface substantially intersecting with a surface of revolution defined by said bore, said second feed line having a selected vertical displacement from a horizontal plane defined by at least one of said barrel ribs.

3. A pistol according to claim 1, further comprising detachable magazine means, mountable in said handle, for holding sub-caliber cartridges.

4. A pistol according to claim 3, wherein said magazine means includes

A. a magazine adapted to hold cartridges of the larger caliber, and

B. a magazine liner mounted in said magazine and adapted to hold sub-caliber cartridges.

5. A conversion unit according to claim 2, further comprising detachable magazine means, mountable in said handle, for holding sub-caliber cartridges.

6. A conversion unit according to claim 5, wherein said magazine means includes

A. a magazine adapted to hold cartridges of the larger caliber, and

B. a magazine liner mounted in said magazine and adapted to hold sub-caliber cartridges.

7. A pistol according to claim 3, wherein said magazine means further includes means for holding cartridges of the larger caliber.

8. A conversion unit according to claim 5, wherein said magazine means further includes means for holding cartridges of the larger caliber.

9. A pistol according to claim 1, wherein said feed spacer means and said barrel lug are joined by fused metal.

10. A conversion unit according to claim 2, wherein said feed spacer means and said barrel lug are joined by fused metal.

11. A pistol according to claim 1, wherein said feed spacer means is welded to said barrel lug.

12. A conversion unit according to claim 2, wherein said feed spacer means is welded to said barrel lug.

13. A pistol according to claim 4, where said magazine liner is adapted to hold rimmed cartridges.

14. A conversion unit according to claim 6, wherein said magazine liner is adapted to hold rimmed cartridges.

15. A pistol according to claim 1, wherein said feed spacer means is integrally formed with said interchangeable barrel.

16. A conversion unit according to claim 2, wherein said feed spacer means is integrally formed with said interchangeable barrel.

* * * * *